US005533691A

United States Patent [19]

Doyle et al.

[11] Patent Number: 5,533,691

[45] Date of Patent: Jul. 9, 1996

[54] MANDREL WITH TWIST LOCK APPARATUS

[75] Inventors: Kevin J. Doyle; Gary N. Eastlund, both of Woodbury, Minn.

[73] Assignee: Minnesota Mining and Manufacturing Company, St. Paul, Minn.

[21] Appl. No.: 292,734

[22] Filed: Aug. 18, 1994

[51] Int. Cl.[6] ..... B65H 16/04; B65H 18/04

[52] U.S. Cl. ..... 242/597.4

[58] Field of Search ..... 242/597.4, 597.5, 242/597.6, 129.5, 129.7, 129.71, 130, 134, 141; 269/52

[56] References Cited

U.S. PATENT DOCUMENTS

| | | | |
|---|---|---|---|
| 1,069,961 | 8/1913 | Kuczynski | 242/597.4 |
| 1,394,177 | 10/1921 | Jones | 242/597.4 X |
| 1,724,034 | 8/1929 | Mayer | 242/597.4 X |
| 1,815,269 | 7/1931 | Nydegger | 242/597.4 X |
| 3,951,354 | 4/1976 | Bagby | 242/597.4 X |
| 4,117,988 | 10/1978 | Moore | 242/597.4 X |
| 4,367,666 | 1/1983 | Toth | 83/203 |
| 4,500,047 | 2/1985 | Merlin . | |
| 4,566,647 | 1/1986 | Iwamoto et al. . | |
| 5,125,590 | 6/1992 | LeCompte | 242/118.4 |
| 5,238,198 | 8/1993 | Jingu et al. . | |
| 5,269,871 | 12/1993 | Longworth et al. | 156/527 |
| 5,310,107 | 5/1994 | Todd et al. | 226/196 |
| 5,316,811 | 5/1994 | Focke et al. | 428/43 |
| 5,322,235 | 6/1994 | Focke et al. . | |

OTHER PUBLICATIONS

Advertisement entitled "Tilt–Dualock Chucks" by Tilt–Lock, Inc. (undated).

Drawing entitled "Collar Stock Roll" by Minnesota Mining and Manufacturing Company, dated Jun. 14, 1962.

*Primary Examiner*—John M. Jillions

*Attorney, Agent, or Firm*—Gary L. Griswold; Walter N. Kirn; Peter L. Olson

[57] ABSTRACT

A locking device to be used with a rotating mandrel to lock the core of a roll of material that is to be wound or unwound into engagement with the mandrel. The mandrel has a cylindrical exterior surface, a rotatable cantilever support at an inward end, and an outward unsupported end adapted to receive the core of the roll of material. The locking device comprises a locking hub for compressively engaging and locking the core. The locking hub includes at least one pin fixedly coupled to an interior cylindrical surface as well as an engaging surface directed toward the inward end of the mandrel to engage the end of the core. The locking device further includes a sleeve mounted on the mandrel and having structure defining a groove or grooves formed in a generally spiral shape for lockingly engaging the at least one pin. Alternatively, the grooves are formed in the cylindrical exterior surface of the mandrel proximate the unsupported end thereof, obviating the need for the sleeve.

22 Claims, 6 Drawing Sheets

MANDREL WITH TWIST LOCK APPARATUS

CROSS-REFERENCE TO RELATED APPLICATION

The present invention is an improvement to an embodiment of the invention of application Ser. No. 08/004,708, now abandoned, filed Jan. 14, 1993 and assigned to the assignee of the present invention.

FIELD OF THE INVENTION

The invention relates to an improved device for use with winding and unwinding apparatus such as is used in joining retroreflective cube corner sheeting. More particularly, the invention relates to a locking device for locking a core of a roll of material on a winding or unwinding cantilevered mandrel.

BACKGROUND

The manufacture of durable traffic control signs and other signage for use in work zones or other traffic areas utilizes many different types of material. A preferred material comprises fluorescent retroreflective cube corner sheeting, also known in some instances as SCOTCHLIGHT™ Brand Durable Fluorescent Diamond Grade Sheeting 3924 F/G Orange. The sheeting consists generally of prismatic lenses formed in a transparent synthetic resin which is sealed and backed with a pressure sensitive adhesive and polyethylene liner. The sheeting is then applied to a substrate and then sized according to the particular application. Certain types and sizes of retroreflective cube corner sheeting are required for use in specific applications. For example, in a construction work zone it is preferable to have very large signage faces, and therefore it is necessary to combine more than one standard sheet of sign material in order to manufacture large size sign configurations. Current work zone requirements in many countries include signs with face dimensions of up to approximately 121.92 centimeters (cm) (48 inches) per side.

When manufacturing very large signs, it is normally necessary to use more than one roll of sheeting material. This is due to manufacturing limitations that have prevented production of certain retroreflective cube corner sheetings at sizes greater than 91.44 cm (36 inches) wide. Therefore, it has been necessary to simultaneously unwind sheeting material from a 91.44 cm (36 inch) roll and a 30.48 cm (12 inch) roll in order to produce a sign of 121.92 cm (48 inch) width. The distance between the two rolls as applied to the substrate that forms the sign backing has to be accurately controlled to permit the two rolls to expand and contract due to weather changes and yet to present the image of a contiguous sign to the observer. The distance between the two rolls is preferably 0.079 cm (1/32 inch).

Cantilevered mandrels are typically used to support the core of wound material that is being either wound or unwound. In the application for use with the production of signage, the material is being unwound from the core and adhesively applied to a substrate, thus forming the sign. It is important that the core be held stationary with respect to the mandrel as the material supported by the core is being wound or unwound. In the past, the mandrel had an inner fixed hub. The mandrel was designed with an exterior diameter that was substantially less than the inside diameter of the core. A tubular locking device was slid over the mandrel and affixed thereto. The core was then slid over the locking device and butted against the inner fixed hub.

The locking device is typically what can be described as an internal locking, core gripping chuck. This type of chuck may have a plurality of pivoting triangular locking teeth. In the non-rotating position such teeth pivot to a position that is within a slot in the locking device and are flush with the exterior surface of the locking device in order to facilitate slipping the core over the locking device. Alternatively, it may have a moveable knurled rod that advances up a ramp to engage the inside of the core.

After slipping the core onto the mandrel over the core gripping chuck, a removable outer hub was slipped onto the mandrel, abutted to the core, and mechanically locked to the mandrel. The locking is usually accomplished by a set screw that had a knurled knob for manual rotation by the operator that protruded radially beyond the surface of the outer hub.

In operation, as the mandrel is rotated to wind or unwind the material on the core, the locking teeth of the core gripping chuck were drawn radially outward by the pivoting action of the triangular section of the engaging teeth of the core stripping lock and engaged the inside of the core. In engagement, the teeth held the core rotationally stationary with respect to the mandrel.

The disadvantages to this design are that the core gripping chucks are expensive devices, the protruding set screw constituted a safety hazard to the operator as it rotated, and it was difficult to achieve a very accurate axial positioning of the core on the mandrel. This latter disadvantage was particularly troublesome when trying to position the material from one mandrel next to the material from a second mandrel on a substrate and to maintain a constant 0.079 cm (1/32 inch) separation between the two materials as applied to the substrate.

It would be a distinct advantage to have a locking device for a core on a mandrel that would reduce cost. A way to reduce cost would be to eliminate the need for the core gripping chucks. The device should also be as inherently safe as possible. The operator must be able to accurately position the axial location of the core on the mandrel. This operation must be able to be performed both quickly and easily.

SUMMARY OF THE INVENTION

The present invention eliminates the need for the core gripping chucks and realizes a substantial cost reduction in this manner. Additionally, the device is inherently more safe to operate in that the protruding set screw knob is eliminated. Further, by providing a locking device that is axially adjustable through a considerable range of lengths of cores, the operator can accurately axially position the core on the mandrel much more easily and quickly than when using existing devices.

The invention comprises a locking device that is adapted to be used with a mandrel by merely twisting it into locking engagement with the core. The mandrel has a cylindrical exterior surface, a rotatable cantilever support at an inward end, and an outward unsupported end adapted to receive the core of a roll of material to be wound or unwound on the core. The locking device comprises a locking hub for compressively engaging and locking the core. The locking hub has an interior cylindrical surface adapted to slidingly engage the cylindrical exterior surface of the mandrel proximate the unsupported end of the mandrel. Further, the locking hub includes at least one pin fixedly coupled to the interior cylindrical surface as well as an engaging surface directed toward the inward end of the mandrel adapted to engage the end of the core.

The locking device has structure defining a groove or grooves formed in a generally spiral shape for lockingly engaging the at least one pin. The grooves are formed in the cylindrical exterior surface of the mandrel proximate the unsupported end thereof and originate at the unsupported end and proceed therefrom toward the inward end of the mandrel. Alternatively, when the locking device is retrofitted to an existing mandrel, the groove or grooves may be formed in a sleeve that is disposed on the mandrel proximate the unsupported end thereof.

These figures, which are idealized, are not to scale and are intended to be merely illustrative and non-limiting.

DETAILED DESCRIPTION OF ILLUSTRATIVE EMBODIMENTS

Use of retroreflective cube corner sheeting, such as SCOTCHLIGHT™ Brand Durable Fluorescent Diamond Grade Sheeting 3924F/G Orange, manufactured by 3M Company, has greatly improved the recognition of signage at construction work zones as well as in other traffic control applications. The retroreflective cube corner material is normally pre-coated with a pressure sensitive adhesive for application to a sign backing substrate. Currently there is great demand for signs having dimensions of about 121.92 cm (48 inches) per side. However, due to manufacturing restrictions, retroreflective cube corner sheeting is only manufactured in dimensions up to a maximum of about 91.44 cm (36 inches) in width. Accordingly, it is necessary to combine a plurality of sheets to manufacture signage of greater dimensions per side. This has normally been accomplished through use of the techniques described above which include a manual lamination process or a motorized squeeze roll lamination process.

In both the manual as well as the motorized lamination processes for assembly of a plurality of sheetings, it is necessary to maintain a separation distance between the adjacent sheetings of about 0.159 cm (1/16 inch) to about 0.079 cm (1/32inch). This is due to the shrinkage and expansion of the materials caused by weathering of the signage. Due to the replacement rate required to maintain optical standards, even for the best quality signs, it is desired to provide increased productivity in the manufacture of the signs as well as to improve the precision in the separation distance between sheetings. These improvements will minimize rejects and reduce costs.

Figure 1:
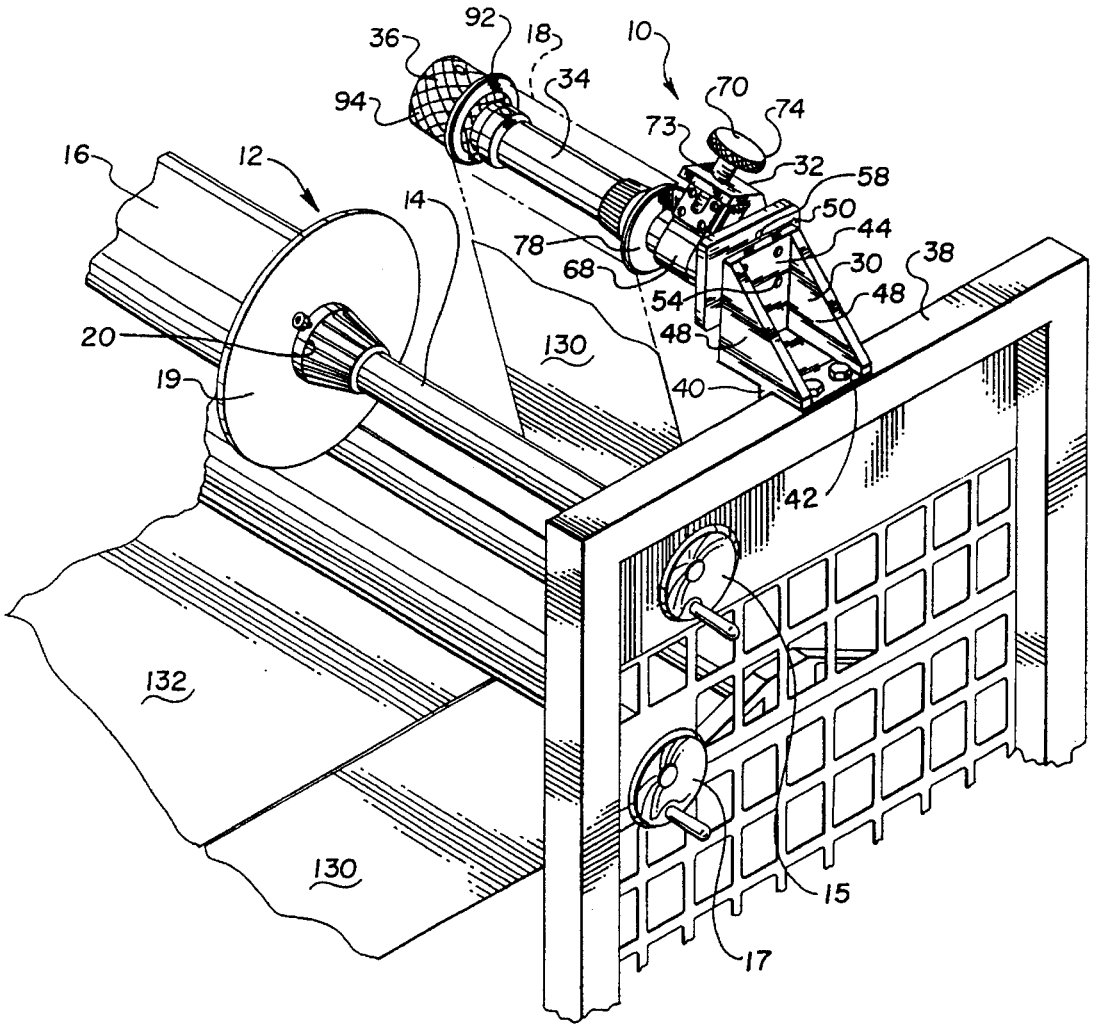
FIG. 1 is a perspective view of a roll applicator apparatus illustrating use of a removable and adjustable auxiliary mandrel subsystem suitable for incorporating the present invention for supporting a second roll of sheeting.

FIG. 1 discloses an embodiment of the mandrel system of the present invention, shown generally at 10 that is adapted for retrofit to a roll applicator apparatus 12 for splicing retroreflective cube corner sheeting during lamination. It is understood that the present invention is useful with many existing rotating mandrels used for winding and unwinding of material on a core. FIG. 1 depicts, in perspective view, the mandrel system of the present invention, mounted to a roll applicator apparatus 12. Roll applicator apparatus 12 comprises a rotatable main shaft 14 suitable for supporting and dispensing a first roll 16 of retroreflective cube corner sheeting, and the mandrel system 10 suitable for supporting and dispensing a second roll 18 of retroreflective cube corner sheeting. The embodiment of FIG. 1 depicts the mandrel system 10 adapted in a manner which permits adding the mandrel system 10 in a relatively simple manner to an existing roll applicator apparatus 12.

In the embodiment depicted in FIG. 1, main shaft 14 rotates at a desired speed, and is controlled using tensioned movement as determined by brake adjustment mechanism 15. Main shaft 14 traverse adjustment mechanism 17 is also provided. Axial spacer 19 is optionally used along with clamp means 20, which may comprise a tapered collar or spool clamp of various sizes or shapes. In essence, it is only necessary to fix the axial location of roll 16 with whatever means necessary and convenient. Mandrel system 10 preferably comprises a subsystem mounted to roll applicator apparatus 12 as a retrofit to the preexisting roll applicator 12. The relatively few parts involved in adding on the mandrel system 10 as depicted in FIG. 1, provide great advantage to this embodiment. In particular, this embodiment permits modification of pre-existing machines of various design with a relatively simple addition of an application kit comprising ergonomic and user friendly components which permit rapid addition of a second roll of retroreflective cube corner sheeting for use in a unique side by side splicing process during lamination.

Figure 2:
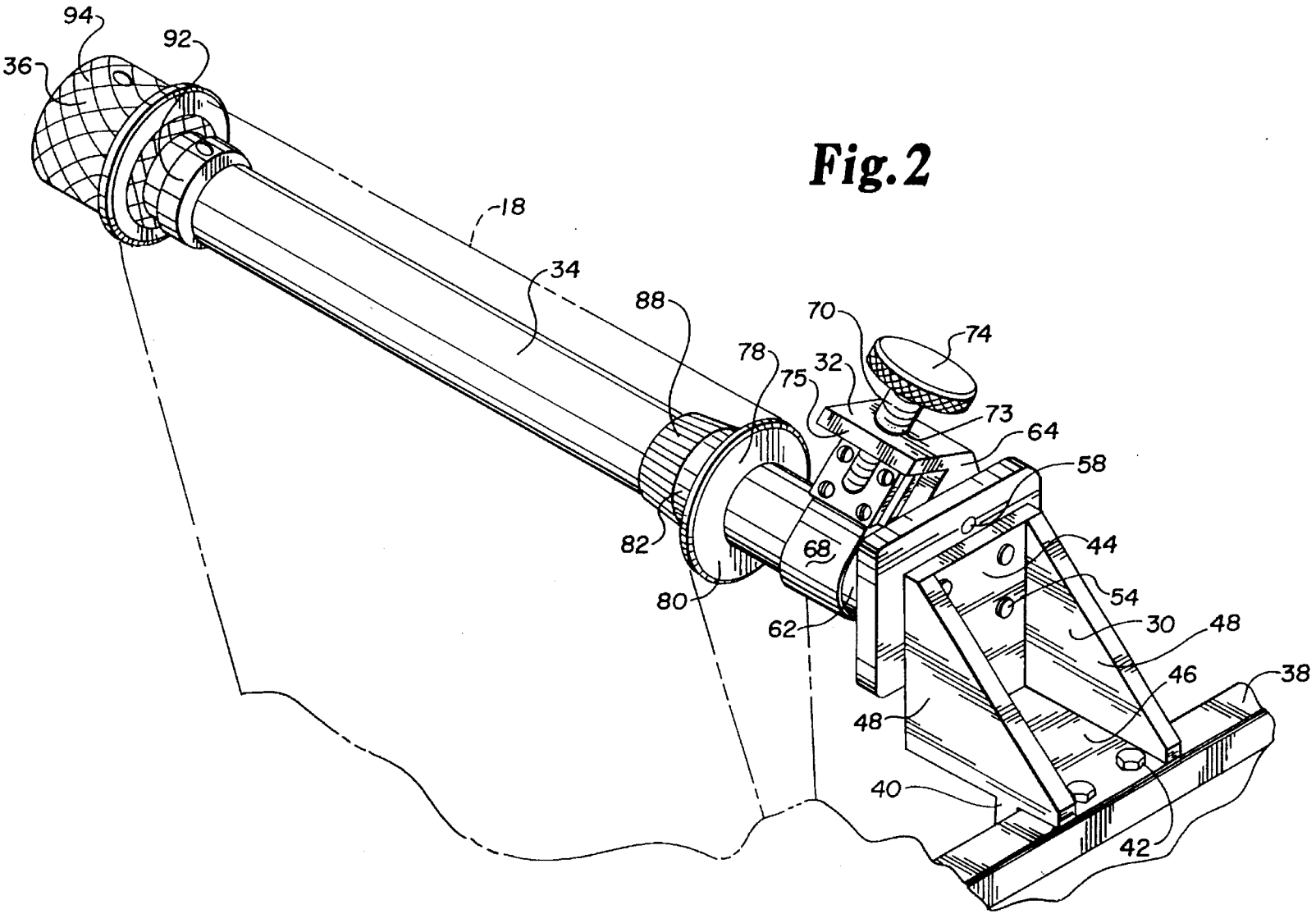
FIG. 2 is a perspective view of the mandrel and the locking device as designed to be retrofit to the existing roll applicator apparatus of FIG. 1.

FIG. 2 is a perspective depiction of mandrel system 10. Mandrel system 10 has four major subcomponents; mounting bracket 30, brake 32, mandrel 34, and locking device 36.

Mandrel system 10 as depicted in FIG. 1 and with more particularity in FIG. 2 is adapted to be added to an existing roll applicator apparatus 12 by being mounted on existing frame 38. Mounting bracket 30 is an L shaped bracket having right angle sides 44, 46 that are strengthened by gussets 48. Mounting bracket 30 has a lower right angle portion 40 specifically designed to be mounted to specific existing frame 38. It is understood that mounting bracket 30 can be conventionally adapted to mount to a wide variety of existing frames 38. In the present instance, mounting is effected by bolts 42 that pass through bores (not shown) in lower portion 40 of mounting bracket 30 and into threaded bores (not shown) in existing frame 38.

Figure 3:
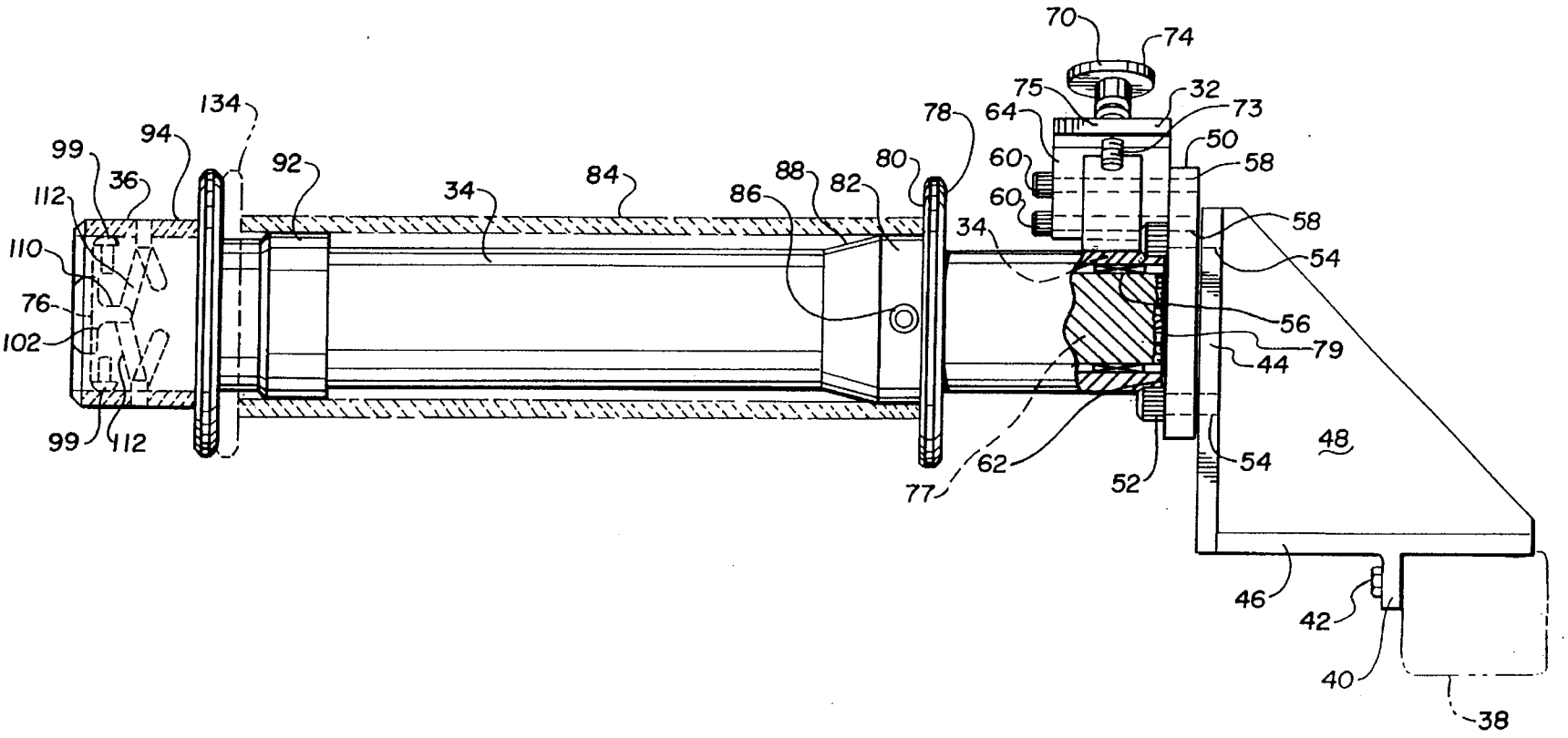
FIG. 3 is a side elevational view of the mandrel and the locking device of the present invention.

As depicted in FIGS. 2 and 3, mounting bracket 30 has interface fixture 50 affixed to side 44. Fixture 50 is a metallic member designed to mate brake 32 and mandrel 34 to mounting bracket 30. Four bolts 52, threaded into threaded bores 54 formed in side 44, secure fixture 50 to mounting bracket 30. Fixture 50 additionally includes threaded bores 58 for receiving bolts 60 that support brake 32.

Brake 32 is of conventional design. Threaded bolts 60 pass through block 64 and engage the threads of threaded bores 58, thereby securing brake 32 to fixture 50. Block 64 is generally triangular in cross section, and includes a retainer (not shown) that fixedly holds a first end of strap 68 to block 64. Strap 68 is preferably made of leather.

Strap 68 loops beneath mandrel 34 and is affixed at the second end of strap 68 to the tensioner 70. Tensioner 70 is a threaded bolt that is threaded through projection 75. Projection 75 extends at an angle from the upper portion of mounting block 64. Tensioner 70 is fitted with a knurled knob 74 that facilitates manually adjusting the tension on strap 68, by adjusting the position of threaded shank 73 relative to the overhang portion 75 of block 64.

Mandrel 34 is of cantilevered design and is comprised of a sleeve that fits over and is rotatably supported by a non-rotating cantilevered mandrel support 77. Support 77 is typically a cylindrical steel bar that is affixed at an end as by weldments 79 to fixture 50 and projects to the left therefrom as depicted in FIG. 3. Mandrel 34 is supported at both ends by a bearing 56, preferably constructed of bronze, that is disposed between the inner diameter of mandrel 34 and the surface of support 77. Referring to the broken out portion of FIG. 3, bearing 56 is depicted rotatably supporting the mandrel 34 at the first inward end 62 thereof. Mandrel 34 is typically constructed of a light metallic material, preferably aluminum, in order to minimize the overhung (cantivered) load. Mandrel 34 is preferably retained on support 77 by a conventional snap ring retainer in a groove defined in support 77 proximate the unsupported outer (left-most, as depicted in FIG. 3) end 76 of mandrel 34.

Mandrel 34 includes an inner core stop 78. Core stop 78 has a disc 80 fixedly mounted to a sleeve 82. Inner core stop 78 is slidably positionable along the axial length of mandrel 34. In this manner, the core 84 of roll 18 that contains the material to be wound or unwound is accurately positionable along mandrel 34. Once the inner core stop 78 is accurately positioned as desired on mandrel 34, set screw 86 is turned into engagement with mandrel 34, thereby holding inner core stop 78 in its selected position. Core 84 is typically formed of hard cardboard paper that may be 0.953 cm (⅜ inch) thick.

Sleeve 82 of inner core stop 78 has a tapered face 88. Tapered face 88 is designed to commence at a diameter that is somewhat less than the inner diameter of the core 84. Tapered face 88 proceeds to a diameter that is only slightly less than the inner diameter of core 84. In this manner, tapered face 88 is used to guide core 84 onto sleeve 82, where core 84 is supported in loose engagement therewith.

Figure 5:
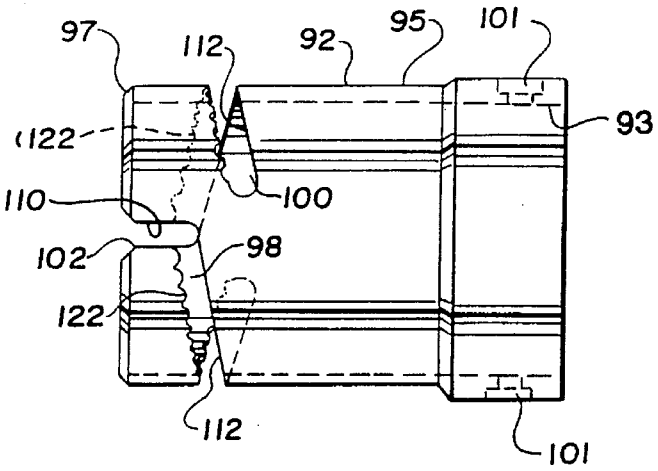
FIG. 5 is a side elevational view of the sleeve portion of the locking device.

The locking device 36 is depicted proximate the outward end 76 of mandrel 34. Locking device 36 has two major subcomponents; sleeve 92 and locking hub 94. The detail of sleeve 92 is best depicted in FIG. 5. In the depiction of FIG. 5, sleeve 92 is oriented similarly to the orientation of sleeve 92 as depicted in FIGS. 1, 2 and 3.

Sleeve 92 is a cylindrical structure, having an inside diameter 93, shown in phantom, that is slightly greater than the outside diameter of mandrel 34, thereby facilitating readily slipping sleeve 92 over mandrel 34. The outside diameter 95 of sleeve 92 is in turn slightly less than the inside diameter of the core 84 and has a chamfer 97 at the outer end. These features facilitate being able to readily slide core 84 over sleeve 92. Sleeve 92 is held in fixed engagement with mandrel 34 by countersunk bolts 99 which pass through bores 101 and engage threaded holes 99 in mandrel 34.

In a preferred embodiment, grooves 98, 100 are formed in the exterior cylindrical surface of sleeve 92. Grooves 98, 100 are opened at the outward end 76 of mandrel 34 and proceed toward the inward end 62 of mandrel 34 in a spiral shape.

Figure 4:
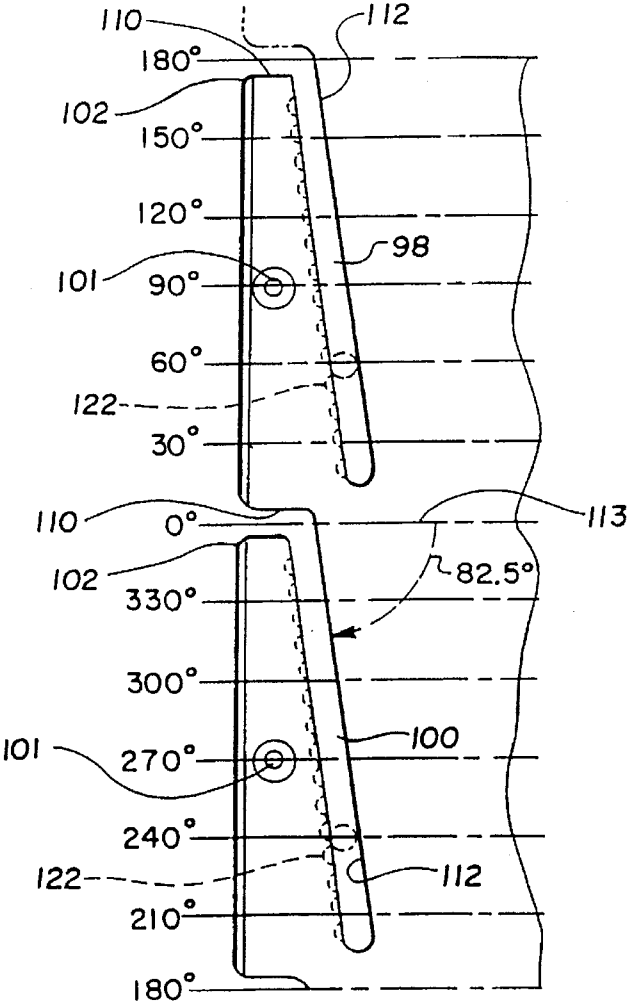
FIG. 4 is a flat layout of the spiral grooves of the sleeve portion of the locking device.
Figure 8:
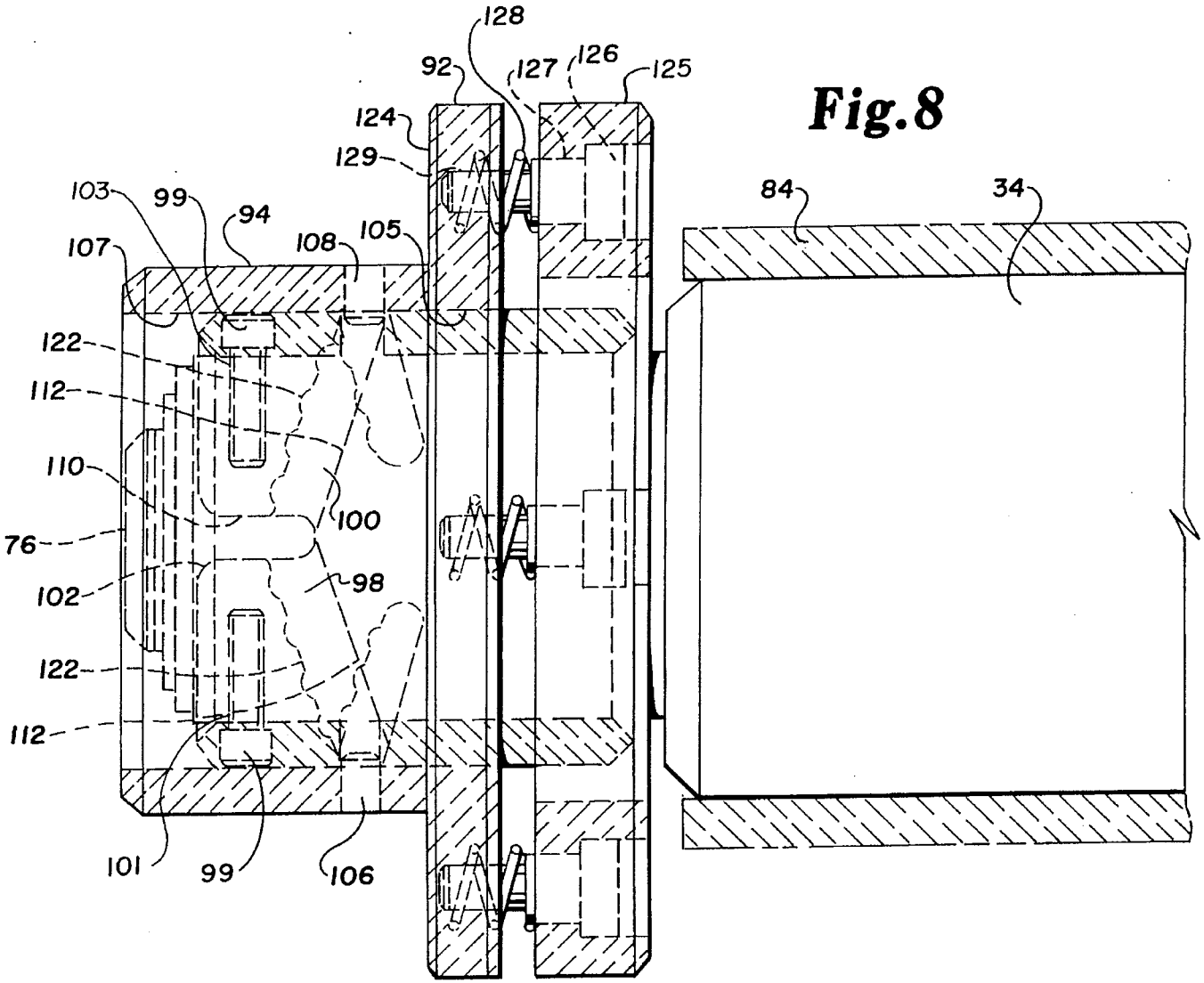
FIG. 8 is a side elevational view of an alternative embodiment of the locking hub portion of the locking device with inner portions depicted in phantom.

As is evident in FIG. 4, there are two openings 102 in sleeve 92. Openings 102 are depicted in FIG. 5 as being diametrically opposed and accordingly overlap such that they appear as a single opening. Likewise, the two straight sections 110 are diametrically opposed and appear in the figure as a single straight section. Spiral sections 112 are depicted with the obscured portion shown as a phantom line to illustrate that spiral sections each wrap slightly less than 180° around sleeve 92. It can be seen that spiral sections 112 have spiral wraps that wrap about sleeve 92 in the same direction of rotation. In an embodiment, the outer wall of spiral sections 112 is preferably formed smooth without the serrations 122, depicted in phantom. The serrations 122 are utilized in conjunction with a second embodiment that is depicted in FIG. 8, as will be later detailed.

FIG. 4 depicts a flat layout of grooves 98, 100 formed in the cylindrical exterior surface of sleeve 92. Grooves 98, 100 have chamfered openings 102 that open proximate the outward end 76 of mandrel 34. Grooves 98, 100 have a short straight section 110 immediately adjacent to opening 102. At the inward end of straight section 110, grooves 98, 100 commence the spiral section 112 wrapped around the exterior surface of sleeve 92. Preferably, each such spiral section 112 continues for approximately one-half of a revolution of sleeve 92. As depicted in FIG. 4, the spiral sections 112 continue through an arc of 165 degrees of revolution. The spiral is shown at an angle of 82.5 degrees with respect to the center axis 113 of sleeve 92. These two angles fix the limits of lateral translation along mandrel 34 that locking hub 94 is capable of when engaged with sleeve 92. Greater or lesser angular relationships are adequate to perform the function as dictated by the amount of lateral translation along mandrel 34 that is desired.

Figure 7:
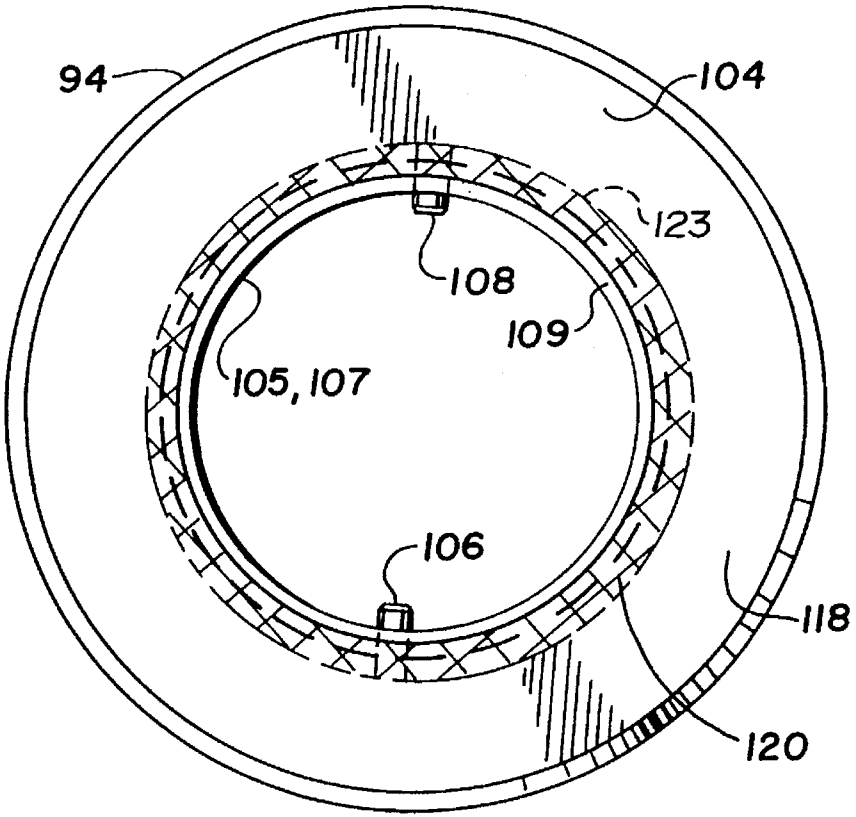
FIG. 7 is an end elevational view of the locking hub portion of the locking device as seen from the end having the engaging face for engaging the core.
Figure 6:
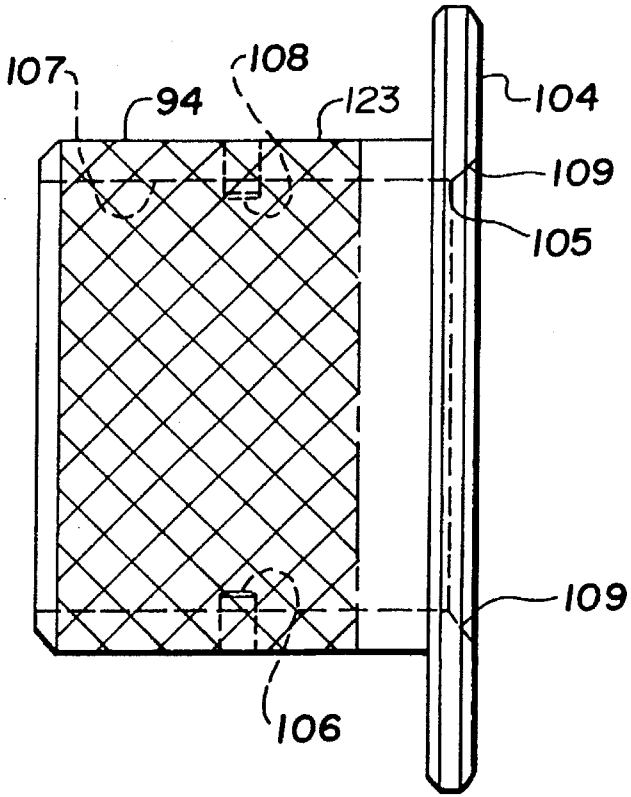
FIG. 6 is a side elevational view of the locking hub portion of the locking device.

Referring to FIGS. 2 and 6, locking hub 94 is a cylindrical device having an inside diameter 107 that is slightly greater than the outside diameter 95 of sleeve 92. This accommodates sliding engagement between locking hub 94 and sleeve 92. Locking hub 94 includes disc 104, fixedly coupled to the inward end of locking hub 94. Disc 104 has a face 118 directed toward the inward end 62 of mandrel 34 that is designed to compressively engage the end of core 84. Disc 104 has an interior bore 105 therethrough that is concentric with and of equal diameter to the interior diameter 107 of locking hub 94. Bore 105 has a chamfer 109 at the inward end of bore 105. The bores 105, 107 are depicted in FIGS. 6 and 7.

Locking hub 94 has two radially inwardly directed pins 106, 108. Pins 106, 108 are fixedly coupled to the interior cylindrical surface of bore 107 of locking hub 94. Pins 106, 108 may be press fit into bores formed in locking hub 94. Pins 106, 108 are designed to ride in grooves 98, 100 respectively. Pins 106, 108 are shown in FIG. 6 as being diametrically opposed. The exterior surface of outer diameter 123 of locking hub 94 is shown having a knurled surface to facilitate the operator gripping locking hub 94 and twisting locking hub 94 into a tight engagement with sleeve 92 and core 84.

The embodiment depicted in FIG. 4 depicts two diametrically opposed grooves 98, 100 and the embodiment shown in FIGS. 2 and 6 has two corresponding pins 106, 108 for engaging the grooves 98, 100. It is understood that the locking device 36 of the present invention is also functional when utilizing only a single groove such as groove 98.

Further, more than the two grooves 98, 100 could be employed for additional strength where needed. It is desirable that the multiple grooves be spaced equiangularly about sleeve 92. When such grooves are not equiangularly displaced, the corresponding pins that are similar to pin 106 must be keyed to a particular groove. This is less than desirable from an operator standpoint since it compels the operator to align a particular pin with a particular groove, which usually takes some searching. When the equiangular configuration is utilized, the pins may be aligned with any of the grooves.

FIG. 7 is an end view of locking hub 94 viewed looking toward the engaging surface 118 of disc 104. Locking pins 106, 108 can be seen protruding radially inward through aperture 105, 107. In this depiction, the portion of engaging face 118 that will actually come in contact with the end of core 84 is shown as having a gripping portion 120 that is knurled. Such knurling increases the frictional compressive engagement between engaging face 118 and core 84.

FIG. 8 depicts an alternative embodiment of sleeve 92 and locking hub 94. The structure of sleeve 92 is shown in phantom within locking hub 94. In this embodiment, the outward most edge of grooves 98, 100 includes serrations 122, also depicted in phantom in FIG. 4. The individual serrations 122 tend to hold locking pins 106, 108 in a selected position, thereby maintaining a constant compressive pressure on the end of core 84.

In this alternative embodiment, locking hub 94 is depicted with a secondary disc 124. Secondary disc 124 is fixedly coupled to locking hub 94. Disc 125, which is analogous in function to disc 104 of the previously described embodiments, is in turn mounted to secondary disc 124 by bolts 126. Bolts 126 are countersunk within disc 125 and pass through a bore 127. Bolts 126 engage a threaded bore 129 formed within secondary disc 124.

Coil springs 128 are disposed concentric with bolts 126 and act to urge disc 125 to the right as depicted in FIG. 8. Additionally, springs 128 act to bias locking pins 106, 108 into engagement with an individual serration 122 formed in grooves 98, 100. Further springs 128 function to provide a certain amount of compliance in the engagement of disc 125 with the end of core 84. Accordingly, disc 125 can be brought into a known compressive engagement with core 84 without the concern of crushing the end of core 84. It is understood that other forms of biasing may be included, such as a circular ribbon spring interposed between disc 125 and secondary disc 124.

In operation, inner core stop 78 is positioned on mandrel 34 such that with core 84 is installed thereon, the winding of the material on to core 84 or unwinding of the material from core 84 is in the proper lateral relationship along mandrel 34 for the job being performed. For example, when used with the roll applicator apparatus 12 in FIG. 1, core stop 78 is positioned on mandrel 34 such that the reflective material 130 unwound from core 84 of roll 18 will be positioned approximately 0.079 cm (1/32 inch) from similar reflective material 132 unwound from first roll 16. Sleeve 92 is also slipped onto mandrel 34 and positioned such that when the core 84 is abutted at a first end against inner core stop 78, the second end of the core 84 will be positioned over the inward end of sleeve 92.

Once inner core stop 78 is properly positioned, core 84 is slid over the outboard end 76 of mandrel 34. Since the outside diameter 95 of sleeve 92 is slightly less than the inside diameter of core 84, core 84 easily slips over sleeve 92. As core 84 is advanced inward along mandrel 34, it rides up over the taper 88 of inner core stop 78 and is loosely engaged therewith. Core 84 is advanced until it abuts core stop 78.

In the above described position, core 84 is ready to be locked in place on mandrel 34. Locking hub 94 must be slipped over the end of sleeve 92 before engaging core 84. Locking hub 94 is rotated until pins 106, 108 are aligned with opening 102 of grooves 98, 100. Locking hub 94 is then advanced over sleeve 92 with pins 106, 108 sliding through straight section 110 of grooves 98, 100. At the end of straight section 110, locking hub 94 is rotated in a twisting motion in the same direction as the direction that mandrel 34 will be rotated to perform the winding or unwinding function, as desired. This twisting rotation continues to advance locking hub 94 on to mandrel 34 as pins 106, 108 move through the spiral section 112 of grooves 98, 100. At a point, depicted in phantom at 134 in FIG. 3, the engaging face 118 of disc 104 will abut the end of core 84, locking core 84 in place. The counter pressure exerted by the locking action on core 84 against locking hub 94 forces pins 106, 108 into locking engagement with the outer side of grooves 98, 100.

Additionally, it is desirable that the direction of spiral of grooves 98, 100 be in the same direction as the direction of rotation of mandrel 34. In this manner, locking hub 94 reacts to the rotational forces generated by mandrel 34 and is urged into tighter engagement with the end of core 84. The embodiment shown in FIG. 8 utilizes coil springs 128 to exert sufficient locking pressure on core 84 and the reactive pressure on pins 106, 108 to engage the serrations 122 in grooves 98, 100.

The previous description is for an embodiment that is designed as a retrofit for existing mandrels 34. It is understood that in a newly designed device, mandrel 34 is built with an outside diameter equal to the outside diameter of sleeve 92. The grooves 98, 100 are then formed within mandrel 34. This embodiment negates the need for a specific sleeve 92. Locking hub 94 is used in an identical manner as previously described to engage the grooves 98, 100 formed in mandrel 34.

When core 84 has been locked in place as previously described, the tension exerted by brake 32 on mandrel 34 is adjusted to provide the desired unwind tension of the material from core 84. In practice, only two or three pounds of restraint are desired to get the proper unwind tension from core 84.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalence of those structures.

What is claimed is:

1. A locking device for use with a rotatable mandrel, the mandrel having a cylindrical exterior surface, a supported inward end, and an outward end designed to receive the core of a roll of material, the material to be wound onto and unwound from the core as desired, comprising:

locking hub means for compressively engaging and locking said core, said hub means having (i) an interior cylindrical surface adapted to slidingly engage said exterior surface of the mandrel proximate the outward end of the mandrel, (ii) at least one locking means coupled to the interior surface of the hub means for locking the hub means to the mandrel, and (iii) an engaging surface adapted to engage the end of the core: and groove means formed in a generally spiral shape in said exterior surface of the mandrel proximate the outward end thereof for cooperatively lockingly engaging said at least one engaging means to hold the core in place on the mandrel, wherein the groove means has an inward side, an outward side and a bottom, the outward side being disposed generally more proximate the outward end of the mandrel and being serrated, the serrations being adapted to receive the locking means of the locking hub means in locking engagement therewith.

2. A locking device for use with a rotatable mandrel, the mandrel having a cylindrical exterior surface, a supported inward end, and an outward end designed to receive the core of a roll of material, the material to be wound onto and unwound from the core as desired, comprising:

locking hub means for compressively engaging and locking said core, said hub means having (i) an interior cylindrical surface adapted to slidingly engage said exterior surface of the mandrel proximate the outward end of the mandrel, (ii) at least one locking means coupled to the interior surface of the hub means for locking the hub means to the mandrel, and (iii) an engaging surface comprising a gripping portion adapted to engage the end of said core; and two groove means defined in said cylindrical exterior surface of the mandrel in a generally spiral shape proximate the outward end thereof, for cooperatively lockingly engaging said at least one engaging means to hold the sore in place on the mandrel, the two groove means being diametrically opposed about the exterior surface of the mandrel.

3. A locking device as claimed in claim 2 wherein the two groove means defined in said cylindrical exterior surface have substantially identical spiral shapes.

4. A locking device as claimed in claim 2 wherein said locking means comprises two diametrically opposed pins in the locking hub means, each of such pins being disposed to engage one of the two groove means defined in said cylindrical exterior surface.

5. A locking device for use with a rotatable mandrel, the mandrel having a cylindrical exterior surface, a supported inward end, and an outward end designed to receive the core of a roll of material, the material to be wound onto and unwound from the core as desired, comprising:

locking hub means for compressively engaging and locking said core, said hub means having (i) an interior cylindrical surface adapted to slidingly engage said exterior surface of the mandrel proximate the outward end of the mandrel, (ii) at least one locking means coupled to the interior surface of the hub means for locking the hub means to the mandrel, and (iii) an engaging surface to engage the end of said core; and groove means formed in a generally spiral shape in said exterior surface of the mandrel proximate the outward end thereof for cooperatively lockingly engaging said at least one engaging means to hold the core in place on the mandrel, wherein the spiral extends through an arc of no more than 180 degrees.

6. A locking device designed to be used with a rotatable mandrel, the mandrel having an outer cylindrical surface defined about a longitudinal axis, an inward end and an outward end, and being rotatably supported in cantilevered manner at the inward end, the mandrel designed to rotate about the longitudinal axis, the outward end of the mandrel being designed to receive a core of a roll of material, the material to be wound onto and unwound from the core, as desired, comprising:

sleeve means for fixedly engaging the mandrel proximate the outward end thereof and having an interior surface and an exterior surface, the interior surface being operably, fixedly coupled to the mandrel, the exterior surface having at least one groove defined therein, the groove fixedly engaging the mandrel proximate the outward end thereof and defining a generally spiral shape; and locking hub means for locking the core of the roll of material in place on the mandrel, being disposed in sliding engagement with the exterior surface of the sleeve means and having core engaging means for compressively engaging the core of the roll of material and groove engaging means for establishing a locking engagement with the groove means, whereby advancing the groove engaging means in the groove means causes the engaging means to compressively engage the core of the roll of material.

7. A locking device as claimed in claim 6 further including biasing means operably coupled to the locking hub means for generating a biasing force that acts to urge the core engaging means into compressive engagement with the core of the roll of material and simultaneously reactively acts to urge the groove engaging means into locking engagement with the groove means.

8. A locking device as claimed in claim 7 wherein the biasing means is disposed between a first fixed portion of the locking hub means and a second translatable portion of the locking hub means, the translatable portion being translatable in the direction defined by the longitudinal axis of the mandrel.

9. A locking device as claimed in claim 7 wherein the groove means has an inward side, an outward side and a bottom, the outward side being disposed generally more proximate the outward end of the mandrel and being serrated, the serrations being adapted to receive the groove engaging means of the locking hub means in locking engagement therewith.

10. A locking device as claimed in claim 6 wherein a plurality of groove means are defined in the cylindrical surface of the sleeve means, the plurality of groove means being equiangularly disposed about the sleeve means.

11. A locking device as claimed in claim 10 wherein the plurality of groove means defined in the cylindrical surface of the sleeve means have substantially identical spiral shapes.

12. A locking device as claimed in claim 10 including a groove engaging means being paired with each of the plurality of groove means for cooperative engagement therewith.

13. A locking device as claimed in claim 6 wherein the at least one groove means defines by spiral that extends through an arc of between one fourth and one half of a revolution around the sleeve means.

14. A locking device as claimed in claim 6 wherein the at least one groove means defines a spiral that subtends an included angle of between seventy-five and eighty-five degrees with respect to the longitudinal axis of the mandrel.

15. A locking device as claimed in claim 6 wherein the mandrel is designed to rotate in a desired direction and wherein the direction of rotation of the spiral groove means is in the direction of rotation of the mandrel, such that reaction to rotation of the mandrel tends to urge the locking hub means into tighter engagement with the core of the material.

16. A mandrel system for winding a material onto a core and unwinding a material from a core, comprising:

a rotatable mandrel, the mandrel having a cylindrical exterior surface concentric with a central longitudinal axis of rotation, a supported inward end, and an outward end designed to receive the core, the mandrel having at least one spiral-shaped groove defined therein; and locking hub means for locking the core in place on the mandrel, said hub means being disposed in sliding engagement with the exterior surface of the mandrel and having core engaging means for compressively engaging the core, and groove engaging means for locking engagement with said at least one groove, whereby advancing the groove engaging means in said at least one groove causes the core engaging means to compressively engage the core, wherein at least one groove has an inward side an outward side, and a bottom, the outward side being disposed generally more proximate the outward end of the mandrel and being serrated, the serrations being adapted to receive groove engaging means of the locking hub means unlocking engagement therewith.

17. A mandrel system as claimed in claim 16 further including biasing means for generating a biasing force that acts to urge the core engaging means into compressive engagement with the core of the roll of material and simultaneously reactively acts to urge the groove engaging means into locking engagement with at least one groove.

18. A mandrel system as claimed in claim 17 wherein the biasing means is disposed between a first fixed portion of the locking hub means and a second translatable portion of the locking hub means, the translatable portion being translatable in the direction defined by the longitudinal axis of the mandrel.

19. A mandrel system as claimed in claim 16 wherein a plurality of grooves are defined in the surface of the mandrel, the plurality of grooves being equiangularly disposed about the mandrel.

20. A mandrel system as claimed in claim 19 wherein the plurality of grooves defined in the cylindrical surface of the sleeve means have substantially identical spiral shapes.

21. A mandrel system as claimed in claim 19 including a groove engaging means being paired with each of the plurality of grooves for cooperative engagement therewith.

22. A mandrel system for winding a material onto a core and unwinding a material from a core, comprising:

a rotatable mandrel, the mandrel having a cylindrical exterior surface concentric with a central longitudinal axis of rotation, a supported inward end, and an outward end designed to receive the core, the mandrel having at least one spiral-shaped groove defined therein, wherein the spiral extends through an arc of no more than 180 degrees; and locking hub means for locking the core in place on the mandrel, said hub means being disposed in sliding engagement with the exterior surface of the mandrel and having core engaging means for compressively engaging the core, and groove engaging means for locking engagement with said at least one groove, whereby advancing the groove engaging means in said at least one groove causes the core engaging means to compressively engage the core.

* * * * *